US009056698B2

(12) United States Patent
Noer

(10) Patent No.: US 9,056,698 B2
(45) Date of Patent: Jun. 16, 2015

(54) CONTAINER

(75) Inventor: Torben Noer, Beder (DK)

(73) Assignee: Superfos A/S, Taastrup (DK)

( * ) Notice: Subject to any disclaimer, the term of this patent is extended or adjusted under 35 U.S.C. 154(b) by 101 days.

(21) Appl. No.: 13/636,928

(22) PCT Filed: Mar. 23, 2011

(86) PCT No.: PCT/EP2011/054437
§ 371 (c)(1),
(2), (4) Date: Dec. 11, 2012

(87) PCT Pub. No.: WO2011/117292
PCT Pub. Date: Sep. 29, 2011

(65) Prior Publication Data

US 2013/0087573 A1 Apr. 11, 2013

(30) Foreign Application Priority Data

Mar. 23, 2010 (EP) ..... 10157381

(51) Int. Cl.
*B65D 43/02* (2006.01)

(52) U.S. Cl.
CPC ..... *B65D 43/0212* (2013.01); *B65D 43/0208* (2013.01); *B65D 43/0231* (2013.01); *B65D 2543/00092* (2013.01); *B65D 2543/00222* (2013.01); *B65D 2543/00296* (2013.01); *B65D 2543/00416* (2013.01); *B65D 2543/00518* (2013.01); *B65D 2543/00657* (2013.01); *B65D 2543/00694* (2013.01); *B65D 2543/0074* (2013.01); *B65D 2543/00805* (2013.01)

(58) Field of Classification Search
CPC ..... B65D 43/0212; B65D 43/0208; B65D 43/0231
USPC ..... 220/293, 788; 215/252, 256, 330, 337
See application file for complete search history.

(56) References Cited

U.S. PATENT DOCUMENTS

| | | | | |
|---|---|---|---|---|
| 2,257,715 | A | 9/1941 | Hopkins | |
| 5,638,976 | A * | 6/1997 | Arnold | 220/298 |
| 7,198,170 | B2 * | 4/2007 | Herr | 220/293 |
| 2008/0105681 | A1 | 5/2008 | Vovan | |

FOREIGN PATENT DOCUMENTS

| | | |
|---|---|---|
| EP | 0960823 | 12/1999 |

* cited by examiner

*Primary Examiner* — Fenn Mathew
*Assistant Examiner* — Elizabeth Volz
(74) *Attorney, Agent, or Firm* — Dykema Gossett PLLC

(57) ABSTRACT

The container (1) has a detachable lid (8) adapted to engage a peripheral rim (5) of a top opening. The peripheral rim has radially protruding flanges (7), and the lid has radially protruding flanges (8) adapted to, in a first angular position of the lid, pass in between the radially protruding flanges of the peripheral rim (5) and, in a second angular position, be engaged with the radially protruding flanges (7) of the peripheral rim. The flanges (7, 8) are adapted to, by pressing the lid (6) onto the peripheral rim, in the second angular position, snap over each other. A skirt portion (12) of the radially outwards protruding flanges (7) of the peripheral rim (5) is provided with a rounded indentation (14) into which a rounded protrusion (15) of a radially inwards protruding flange (8) may snap. Secondary snap faces (19) of the lid (8) forming an acute angle with the central axis (9) of the peripheral rim (5) of the top opening (4) include the rounded protrusions (15) of the radially inwards protruding flanges (8).

11 Claims, 9 Drawing Sheets

CONTAINER

The present invention relates to a container comprising a side wall, a bottom and a top opening with a peripheral rim and being provided with a detachable lid adapted to engage the peripheral rim of the top opening, the peripheral rim of the top opening being provided with a number of mutually spaced, radially protruding flanges, the lid being provided with a corresponding number of mutually spaced, radially protruding flanges adapted to, in a first angular position of the lid relative to the container, pass in between the radially protruding flanges of the peripheral rim of the top opening and subsequently, after rotation of the lid about a central axis of the peripheral rim of the top opening to a second angular position relative to the container, be engaged with the radially protruding flanges of the peripheral rim of the top opening, so that the lid is locked onto the container, the radially protruding flanges of the peripheral rim of the top opening and the radially protruding flanges of the lid, respectively, being adapted to, by pressing the lid onto the peripheral rim of the top opening, in the second angular position of the lid relative to the container, snap over each other, thereby locking the lid onto the container, the radially protruding flanges of the peripheral rim of the top opening and the radially protruding flanges of the lid, respectively, forming primary snap faces adapted to, in the second angular position of the lid relative to the container, mutually contact each other before snapping over each other, the primary snap faces of at least one of the lid and the peripheral rim of the top opening forming an acute angle with the central axis of the peripheral rim of the top opening, the radially protruding flanges of the peripheral rim of the top opening and the radially protruding flanges of the lid, respectively, forming secondary snap faces adapted to, in the second angular position of the lid relative to the container, mutually contact each other after snapping over of the flanges, and the secondary snap faces of the lid forming an acute angle with the central axis of the peripheral rim of the top opening.

Thereby, the lid may be mounted on the container in any angular position of the lid relative to the container; thereby eliminating the need for equipment especially adapted to position the lid in a certain angular position.

US 2008/0105681 A1 describes a container that can be dosed at a plant and can be opened and dosed by a customer. The cover has a lower rim wall with a plurality of radially inward cover projections spaced about the container axis, and the base has a base rim wall with a plurality of recesses with undercut grooves that each receives a cover projection to hold the cover dosed on the base. The bottom surface of the cover projections and the top surface of the base rim wall are beveled, so the cover can be installed by forcefully pushing it down, at any rotational position of the cover on the base. A vertical V-formed jut on a groove wall of the base has a slight interference with a vertical V-formed jut on the cover projection, and the customer may have to apply extra torque to move the juts past one another. The juts prevent loosening of the cover. However, these vertical V-formed juts may obstruct the automatic installation of the cover at a plant at some rotational positions of the cover relative to the base, as the vertical V-formed jut on the groove wall of the base may interfere with the cover projection.

EP 0 960 823 A1 describes a combination of a bucket and a lid, which bucket comprises a generally disc-shaped bottom, a side wall standing along the edge of the bottom and first cams arranged on the mouth rim of the side wall remote from the bottom, and which lid comprises an edge overhanging at least a part of the periphery of the mouth rim of the bucket and second generally wedge-shaped cams arranged on this edge, which first and which second cams are arranged with their active surfaces at overlapping radial positions and can be placed at least partially coinciding; which active surfaces comprise rise surfaces; this such that on preliminary placing of the lid the second cams can pass between the first cams until the lid comes into engagement with the mouth rim, whereafter through rotation of the lid relative to the bucket at least a number of the first and at least a number of the second cams are brought into mutual wedging engagement via said active surfaces such that with said rotation an axial pressing of the lid onto the mouth rim is effected.

U.S. Pat. No. 2,257,715 discloses a snap lock cover arrangement for use with sheet metal containers.

The object of the present invention is to provide a container of the type described in the introductory part, whereby the mounting of the lid on the container is facilitated.

In view of this object, a downwards directed skirt portion of the radially protruding flanges of the peripheral rim of the top opening of the container tapers in its longitudinal direction so that its height is smaller at a first end than at a second end, in that each downwards directed skirt portion of the radially outwards protruding flanges of the peripheral rim is provided with a rounded indentation into which a correspondingly rounded protrusion of a corresponding radially inwards protruding flange may snap in order to subsequently rest there in a second angular position of the lid relative to the container, and in that the secondary snap faces of the lid forming an acute angle with the central axis of the peripheral rim of the top opening include the rounded protrusions of the radially inwards protruding flanges.

Thereby, the lid may be prevented from unintentionally rotating away from said second angular position relative to the container and it may thereby be ensured that the lid is suitably locked onto the container and, at the same time, snapping over of the radially protruding flanges at any angular position of the lid relative to the container may be facilitated in that may be better ensured that the radially protruding flanges snap correctly into locking engagement at any such angular position.

In an embodiment, the flanges of the peripheral rim of the top opening protrude radially outwards, the flanges of the lid protrude radially inwards, and the primary snap faces of at least one of the lid and the peripheral rim of the top opening extend in a downwards and radially outwards direction. Thereby, the flanges of the lid may be provided on the inside of an outer rim of the lid, whereby said outer rim may also serve as a gripping surface for rotating the lid by hand for re-closure of the container.

In an embodiment, the primary snap faces of at least one of the lid and the peripheral rim of the top opening form an angle with the central axis of the peripheral rim of the top opening of less than 75 degrees, preferably less than 70 degrees and more preferred less than 65 degrees. Thereby, snapping over of the radially protruding flanges may be even further facilitated.

In an embodiment, the secondary snap faces of the peripheral rim of the top opening form an acute angle with the central axis of the peripheral rim of the top opening. Thereby, snapping over of the radially protruding flanges may be even further facilitated in that is may be better ensured that the radially protruding flanges snap correctly into locking engagement.

In an embodiment, the flanges of the peripheral rim of the top opening protrude radially outwards, the flanges of the lid protrude radially inwards, and the secondary snap faces of at least one of the lid and the peripheral rim of the top opening extend in an upwards and radially outwards direction. Thereby, a wedge effect may be accomplished whereby the lid is tightened appropriately onto the peripheral rim of the container when the secondary snap faces snap into contact with each other.

In an embodiment, the radially protruding flanges of the lid are provided on a peripheral rim of the lid, and the peripheral rim of the lid is adapted to flex elastically in order to assist the radially protruding flanges of the lid in snapping over the radially protruding flanges of the peripheral rim of the top opening. Thereby, snapping over of the radially protruding flanges may be even further facilitated.

In an embodiment, the peripheral rim of the top opening is adapted to flex elastically in order to assist the radially protruding flanges of the lid in snapping over the radially protruding flanges of the peripheral rim of the top opening. Thereby, snapping over of the radially protruding flanges may be even further facilitated.

In an embodiment, the radially protruding flanges of the peripheral rim of the top opening and the radially protruding flanges of the lid, respectively, are provided with mutually interacting end stops preventing the lid from continued angular rotation in the same direction of rotation, when the lid has been rotated from its first angular position to its second angular position relative to the container. Thereby, it may be secured that the lid is positioned correctly in its second angular position whether it is rotated automatically in an assembly line or it is rotated by hand.

In an embodiment, the detachable lid is provided with a downwards protruding peripheral rim adapted to engage sealingly on the inside of the peripheral rim of the top opening of the container when the lid is mounted on the container. Thereby, a fluid tight seal may be obtained without mounting a sealing foil over the top opening of the container.

In an embodiment, a downwards directed skirt portion of the radially protruding flanges of the peripheral rim of the top opening of the container tapers in its longitudinal direction so that its height is smaller at a first end than at a second end. Thereby, when the lid is rotated in order to engage the radially protruding flanges of the lid under the radially protruding flanges of the peripheral rim of the top opening, the lid may be tightened against the peripheral rim of the top opening, and thereby a sealing effect may be ensured.

The present invention further relates to a method of automatically mounting lids on containers, each container comprising a side wall, a bottom and a top opening with a peripheral rim and being provided with a detachable lid adapted to engage the peripheral rim of the top opening, the peripheral rim of the top opening being provided with a number of mutually spaced, radially protruding flanges, and the lid being provided with a corresponding number of mutually spaced, radially protruding flanges adapted to, in a first angular position of the lid relative to the container, pass in between the radially protruding flanges of the peripheral rim of the top opening and subsequently, after rotation of the lid about a central axis of the peripheral rim of the top opening to a second angular position relative to the container, be engaged with the radially protruding flanges of the peripheral rim of the top opening, so that the lid is locked onto the container, each lid being mounted on a respective container by positioning the lid on the rim of the top opening, pressing the lid onto the peripheral rim of the top opening and providing the lid with a rotational force relative to the container.

The method is characterized by that each lid is positioned on the rim of the top opening of the respective container in any angular position relative to the container, and by that, when the lid is pressed onto the peripheral rim of the top opening, in the case that the lid is not in the first angular position of the lid relative to the container, the radially protruding flanges of the peripheral rim of the top opening and the radially protruding flanges of the lid, respectively, snap over each other, thereby locking the lid onto the container. Thereby, the above-mentioned properties may be obtained.

The invention will now be explained in more detail below by means of examples of embodiments with reference to the very schematic drawing, in which FIG. 1 is a perspective view of a container according to the invention, whereby the lid has been detached from the container;

Figure 1:
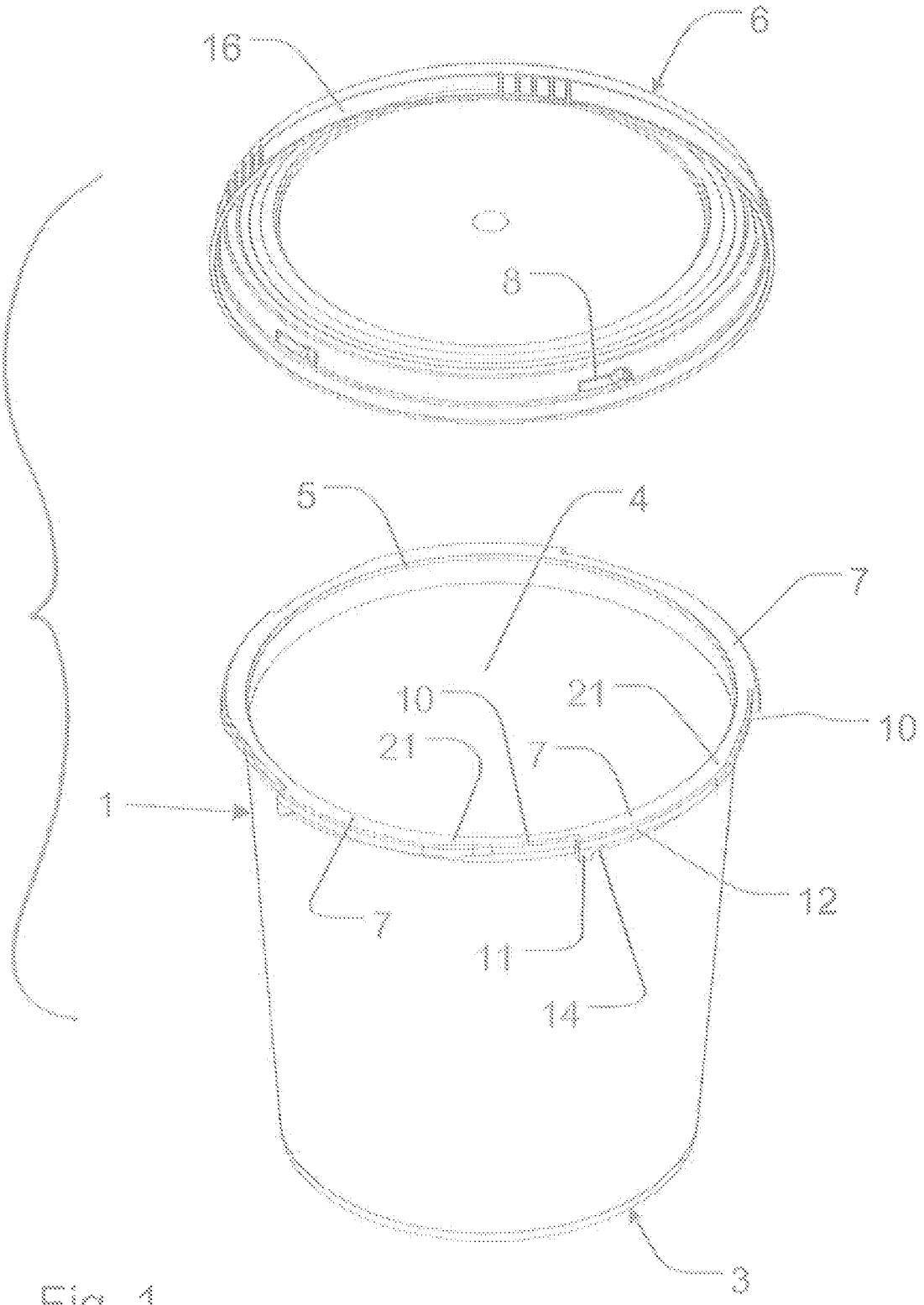

FIG. 1 shows a container 1 comprising a side wall 2, a bottom 3 and a top opening 4 with a peripheral rim 5. The container 1 is provided with a detachable lid 6 adapted to engage the peripheral rim 5 of the top opening 4. The peripheral rim 5 of the top opening 4 is provided with a number of mutually spaced, radially outwards protruding flanges 7, and the lid 6 is provided with a corresponding number of mutually spaced, radially inwards protruding flanges 8 adapted to go into engagement with the radially outwards protruding flanges 7 of the peripheral rim of the top opening, so that the lid 6 is locked onto the container 1. In this locked position, the lid 6 rests on the peripheral rim 5 of the top opening 4 of the container 1, and the radially inwards protruding flanges 8 of the lid 6 are positioned below the radially outwards protruding flanges 7 of the peripheral rim of the top opening; see for instance FIGS. 5 and 6 and FIGS. 7 and 8.

In order to mount the lid 6 on the container 1, firstly, the lid 6 may be positioned in a first angular position of the lid 6 relative to the container 1, whereby the radially inwards protruding flanges 8 of the lid 6 may pass in between the radially outwards protruding flanges 7 of the peripheral rim 5 of the top opening 4. As it may be seen in FIG. 1, each pair of radially outwards protruding flanges 7 of the peripheral rim 5 are separated by means of a space 10. Therefore, in the first angular position of the lid 6 relative to the container 1, each radially inwards protruding flange 8 of the lid 6 is positioned at a space 10 between two radially outwards protruding flanges 7 of the peripheral rim 5, so that the lid 6 may be displaced slightly in downwards direction until abutment against the peripheral rim 5 of the top opening 4, whereby the radially inwards protruding flanges 8 of the lid 6 passes through respective spaces 10 between radially outwards protruding flanges 7 of the peripheral rim 5. Secondly, the lid 6 may be rotated in clockwise direction about a central axis 9 of the peripheral rim 5 of the top opening 4 to a second angular position relative to the container 1, whereby the radially inwards protruding flanges 8 of the lid $ are displaced to a position under and in engagement with the radially outwards protruding flanges 7 of the peripheral rim 5 of the top opening 4, so that the lid 6 is locked onto the container 1.

It is noted that, in the embodiments shown in the figures, the radially outwards protruding flanges 7 of the peripheral rim 5 of the top opening 4 are provided with end stops 11 formed as downwards directed protrusions of a downwards directed skirt portion 12 of the radially outwards protruding flanges 7 of the peripheral rim 5. Correspondingly, the radially inwards protruding flanges 8 of the lid 6 are provided with end stops 13 in the form of end faces adapted to mutually interact with, that is abut, the end stops 11 of the radially outwards protruding flanges 7 in the second angular position of the lid 6 relative to the container 1. Thereby, it may be prevented that the lid 6 may continue its angular rotation in the same rotational direction and thereby leave its second angular position, when the lid 6 has once been rotated from its first angular position to its second angular position relative to the container. As noted above, in the shown embodiments, this rotation is performed in clockwise direction; however, in other embodiments of the lid and container, this rotation may be performed in anti-clockwise direction. The downwards directed skirt portion 12 of the radially outwards protruding flanges 7 of the peripheral rim 5 may, as it is seen, for instance, in FIGS. 1, 7 and 8, taper in its longitudinal direction so that its height is smaller at a first end than at a second end, that is, in the embodiment shown, its height is smaller at its end opposed to the end stop 11 than at its end at the end stop. Thereby, when the lid is rotated in order to engage the radially inwards protruding flanges 8 of the lid 6 under the radially outwards protruding flanges 7 of the peripheral rim of the top opening, the lid may be appropriately tightened against the peripheral rim of the top opening, and thereby a sealing effect may be ensured.

Instead of providing the radially protruding flanges 7 of the peripheral rim 5 with a tapering, downwards directed skirt portion 12, the radially protruding flanges 7 may extend obliquely relative to the horizontal. Alternatively or supplementary, the radially protruding flanges 8 of the lid 6 may have a corresponding tapering form or extend obliquely relative to the horizontal. Thereby, similarly, a tightening effect may be obtained.

It is noted that in the context of this description, the first angular position of the lid 6 relative to the container 1 means any angular position of the lid, in which the radially inwards protruding flanges 8 of the lid 6 may pass in between the radially outwards protruding flanges 7 of the peripheral rim 5 of the top opening 4, as described above. On the other hand, the second angular position of the lid 6 relative to the container 1 means any angular position of the lid in which the lid is not in its first angular position, that is, an angular position in which the radially inwards protruding flanges 8 of the lid 6 may not pass in between the radially outwards protruding flanges 7 of the peripheral rim 5 of the top opening 4.

Figure 7:
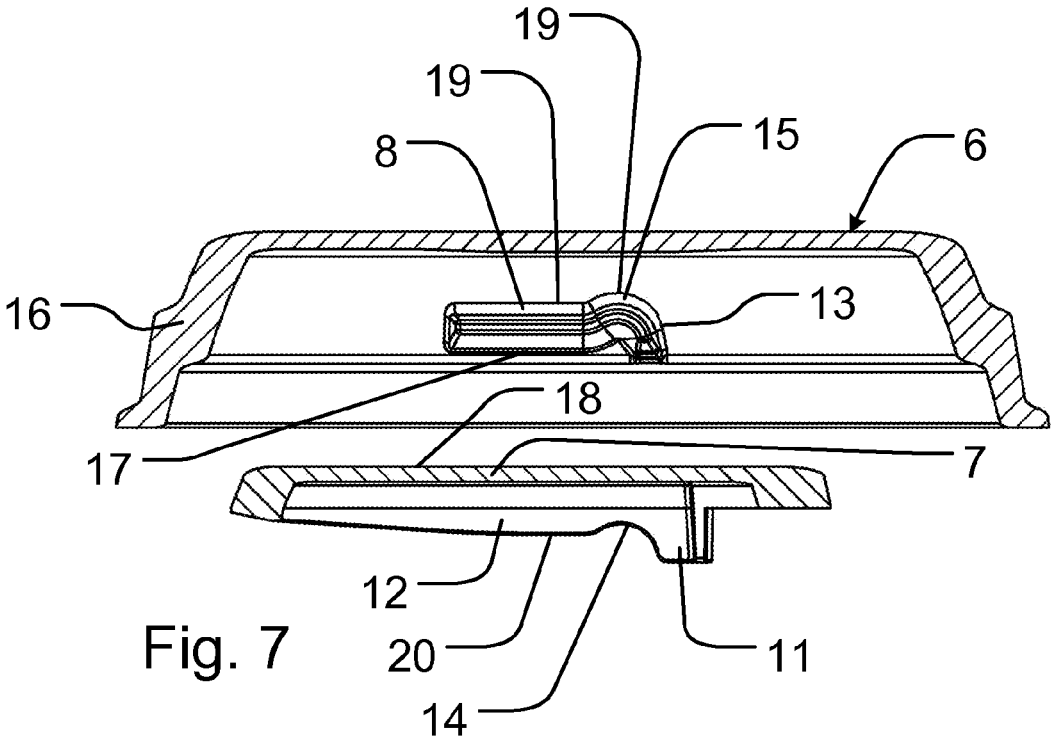
FIG. 7 is a cross-sectional detail on a larger scale of the container as indicated in FIG. 3, whereby the lid has been detached from the container.
Figure 8:
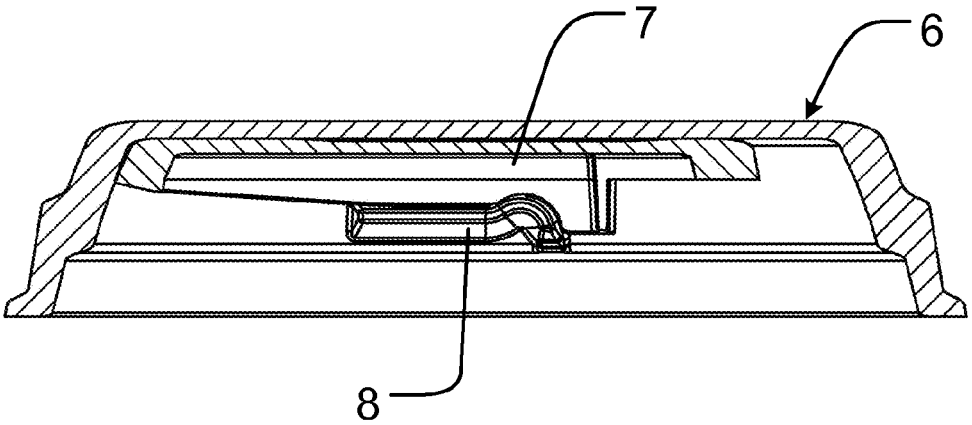
FIG. 8 is the cross-sectional detail of FIG. 7, whereby the lid has been attached on the container.
Figure 9:
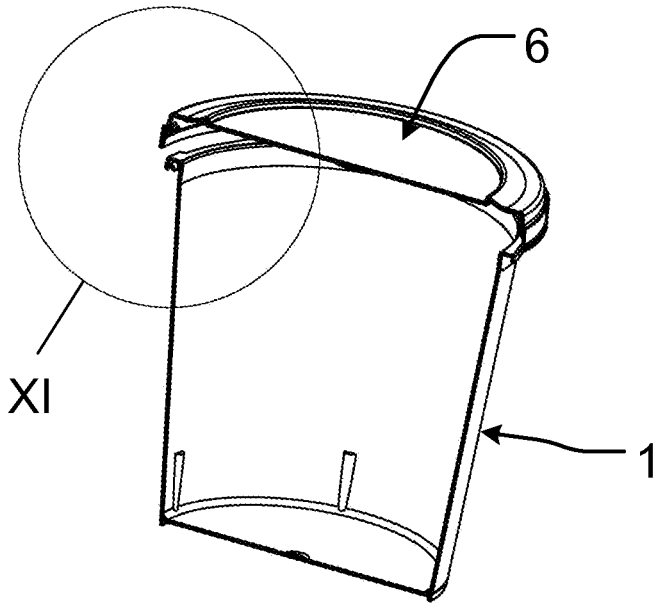
FIG. 9 is a cross-sectional view shown in perspective of the container shown in FIG. 1, whereby the lid has detached from the container.
Figure 10:
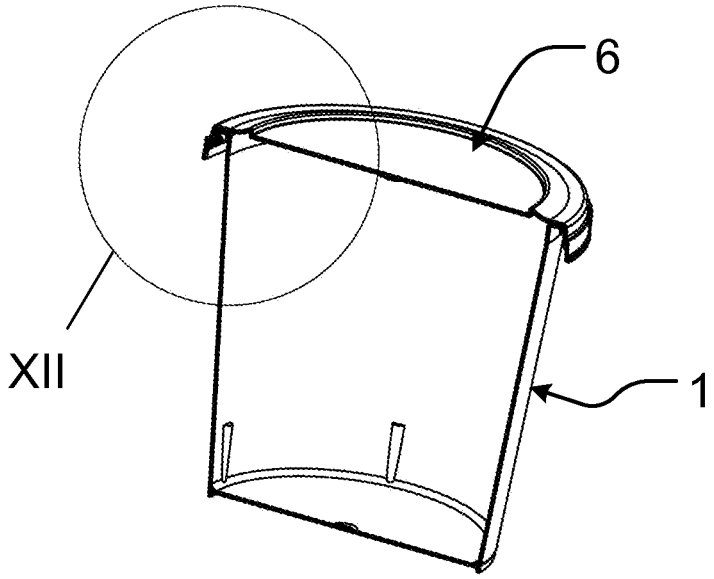
FIG. 10 is the cross-sectional view of FIG. 9, whereby the lid has en attached on the container.
Figure 11:
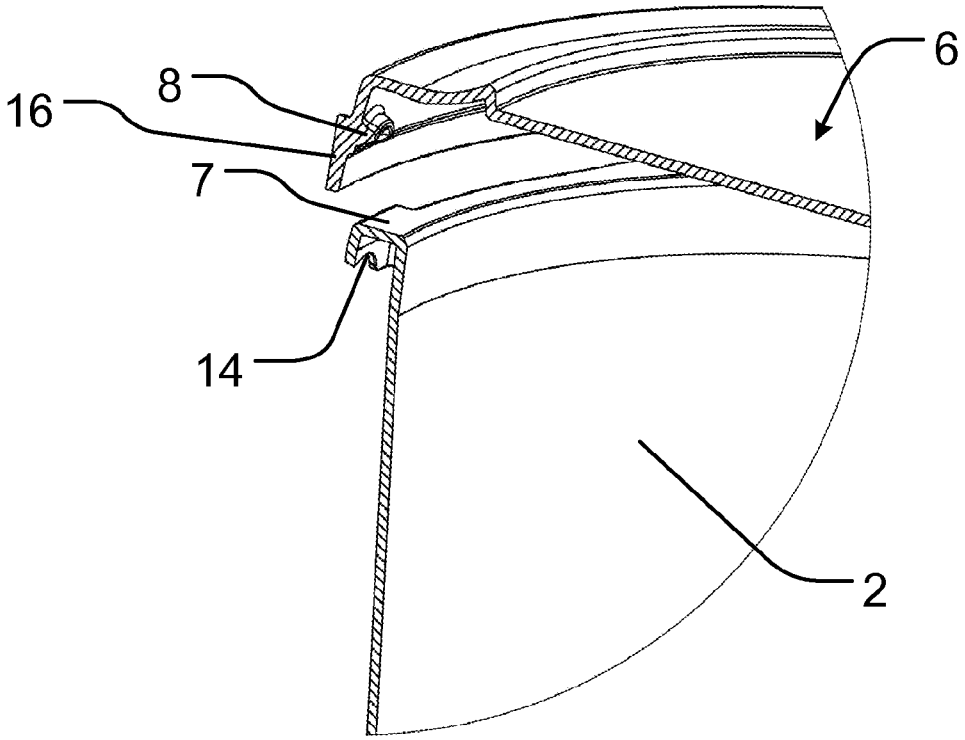
FIG. 11 is a cross-sectional detail on a larger scale of the container as indicated in FIG. 9.
Figure 12:
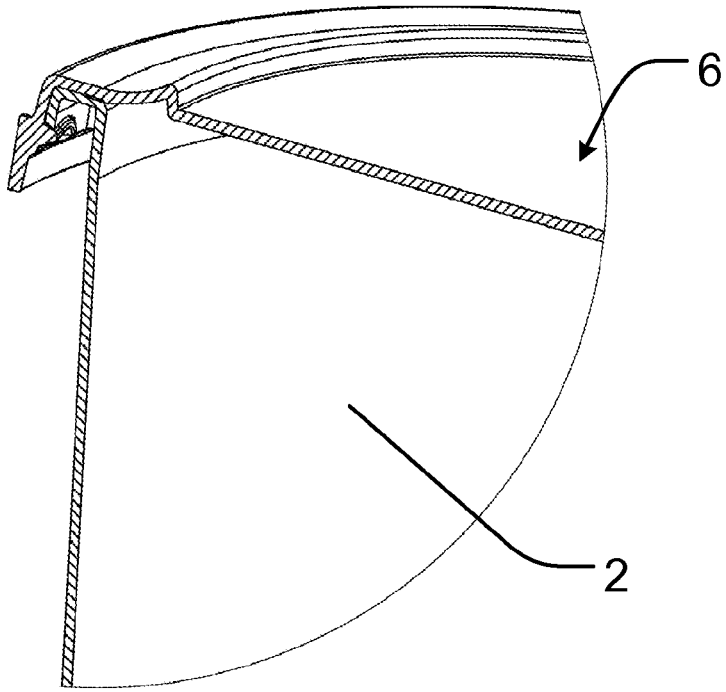
FIG. 12 is a cross-sectional detail on a larger scale of the container as indicated in FIG. 10.
Figure 14:
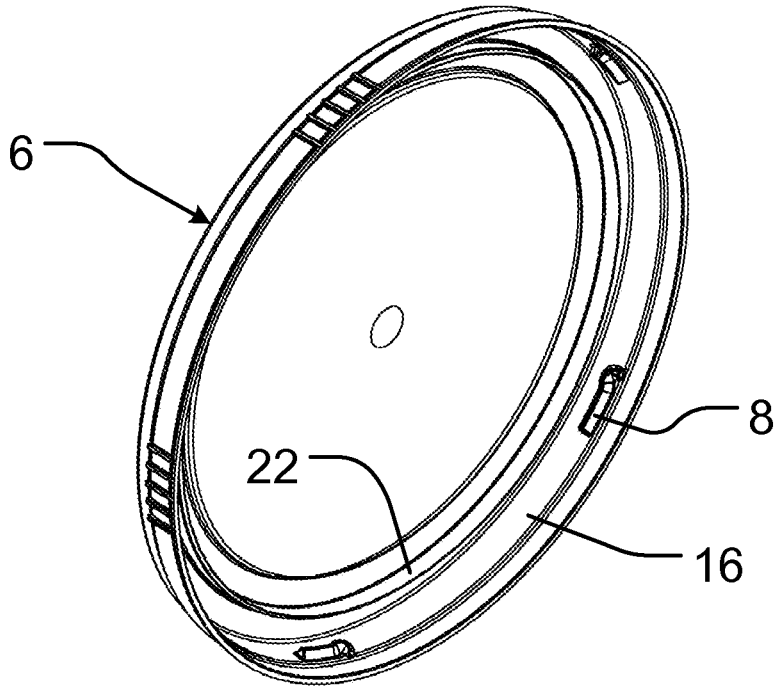
FIG. 14 is a perspective view of the lid of the embodiment of the container shown in FIG. 13.
Figure 13:
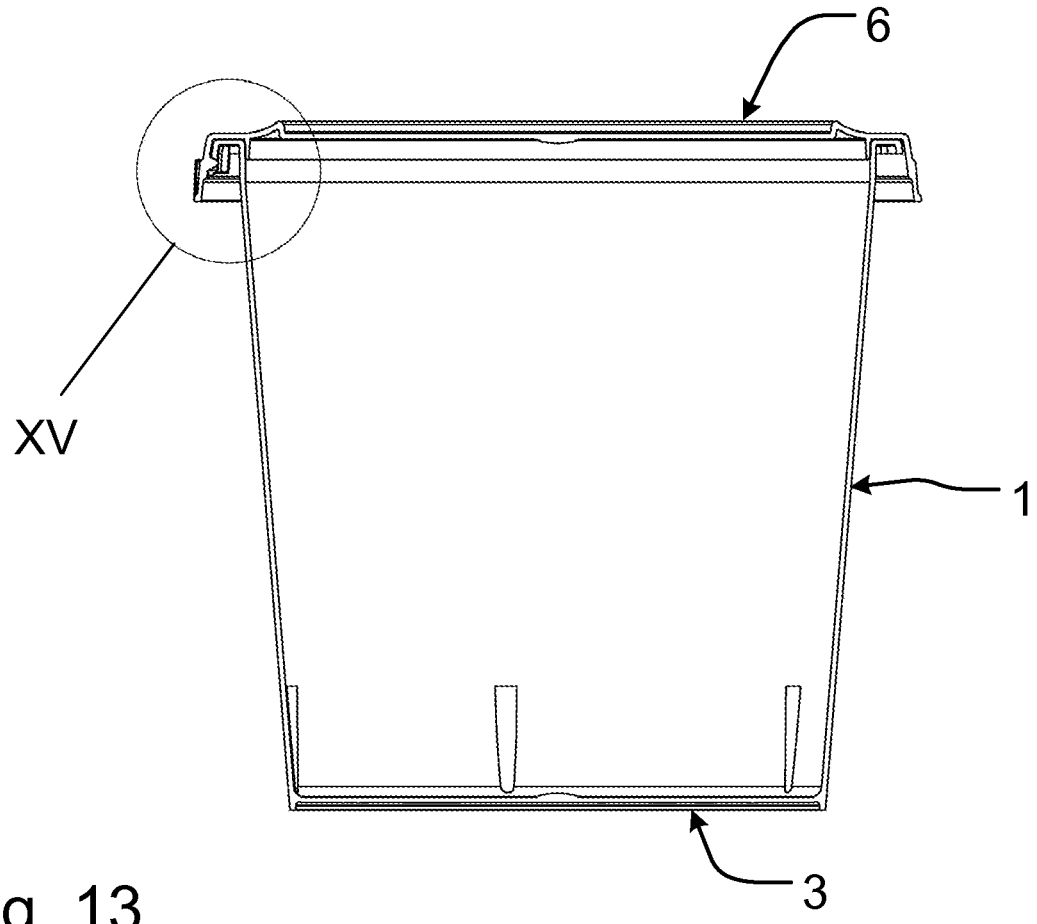
FIG. 13 is an axial section through another embodiment of the container shown in FIG. 2.
Figure 15:
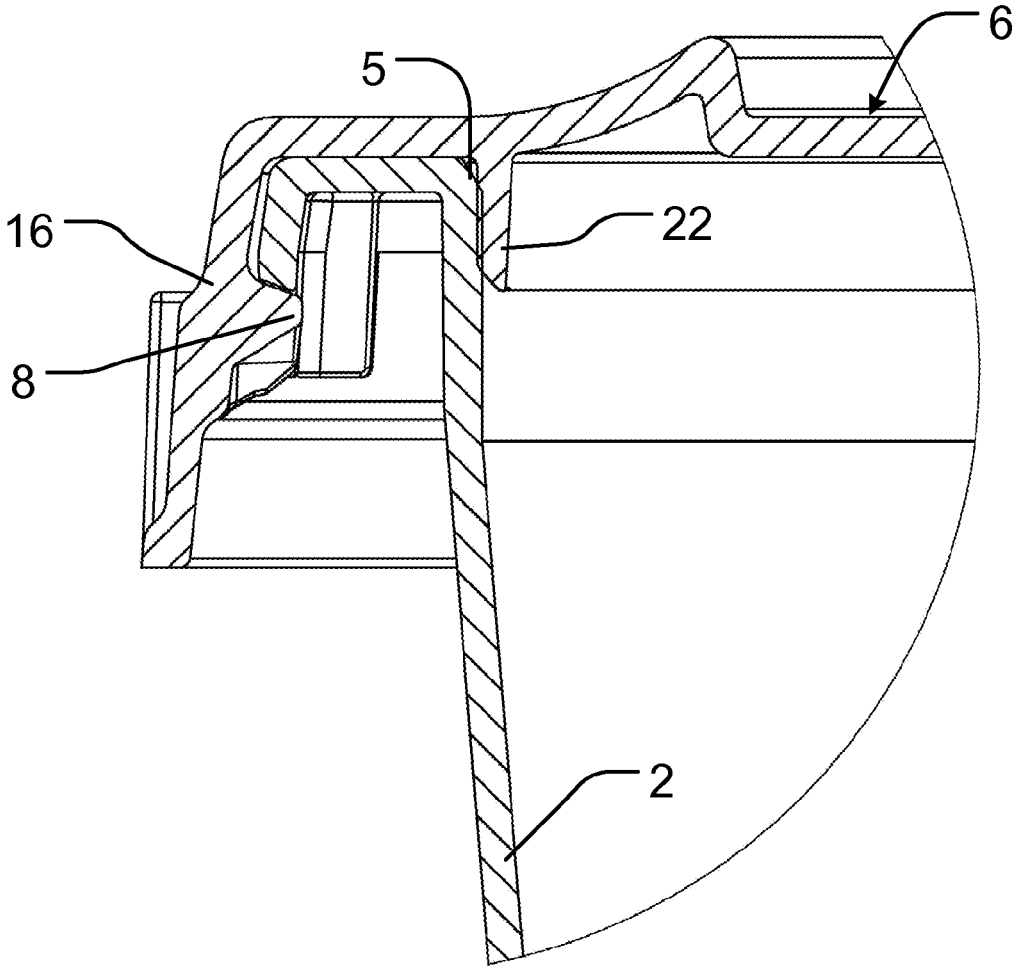
FIG. 15 is a cross-sectional detail on a larger scale of the container as indicated in FIG. 13.
Figure 16:
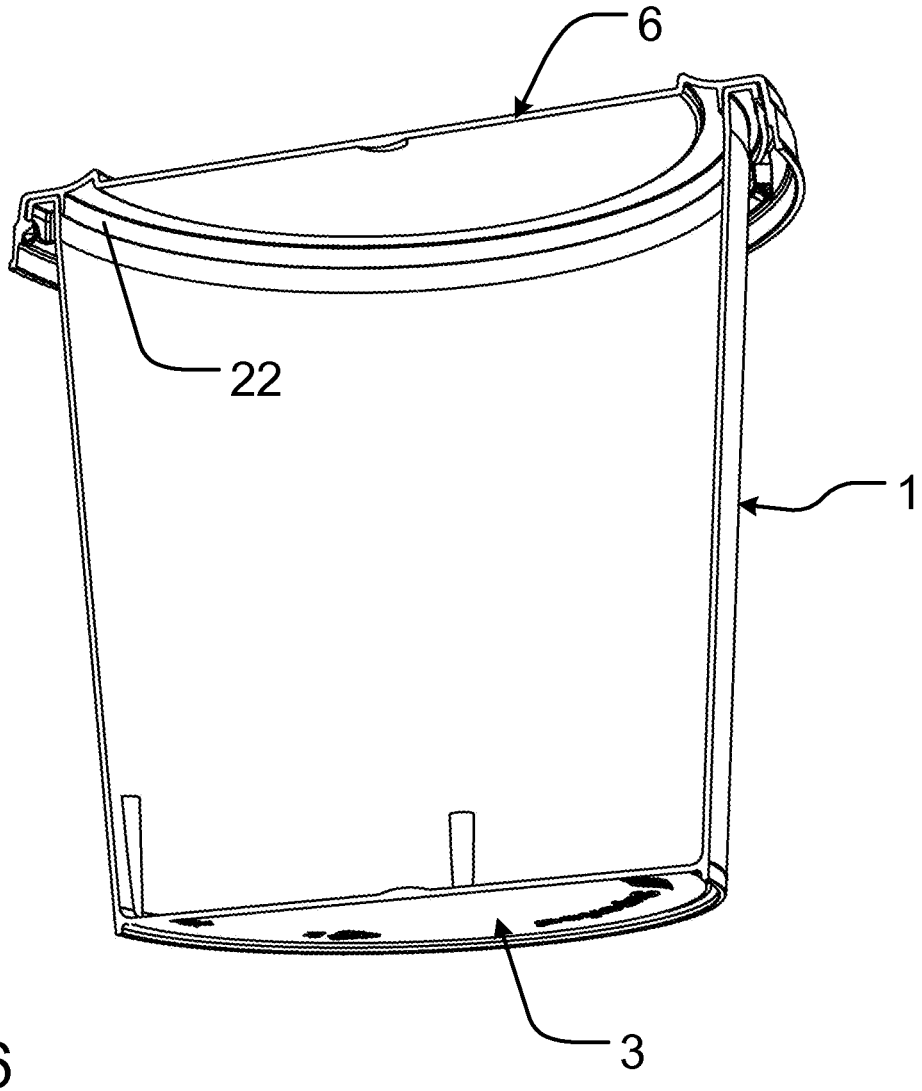
FIG. 16 is a cross-sectional view shown in perspective of the container shown in FIG. 13.

It is furthermore noted that each downwards directed skirt portion 12 of the radially outwards protruding flanges 7 of the peripheral rim 5 is provided with a rounded indentation 14 into which a correspondingly rounded protrusion 15 of a corresponding radially inwards protruding flange 8 may snap in order to subsequently rest there in a second angular position of the lid 6 relative to the container 1. Thereby, the lid 6 may be prevented from unintentionally rotating away from said second angular position relative to the container and it may thereby be ensured that the lid is suitably locked onto the container. As it is seen in FIGS. 7 and 8, the secondary snap faces 19 of the lid 6 forming an acute angle with the central axis 9 of the peripheral rim 5 of the top opening 4 include the rounded protrusions 15 of the radially inwards protruding flanges 8. This means that the rounded protrusions 15 of the radially inwards protruding flanges 8, as the secondary snap faces 19 of the lid 6, also form an acute angle with the central axis 9 of the peripheral rim 5 of the top opening 4.

Figure 5:
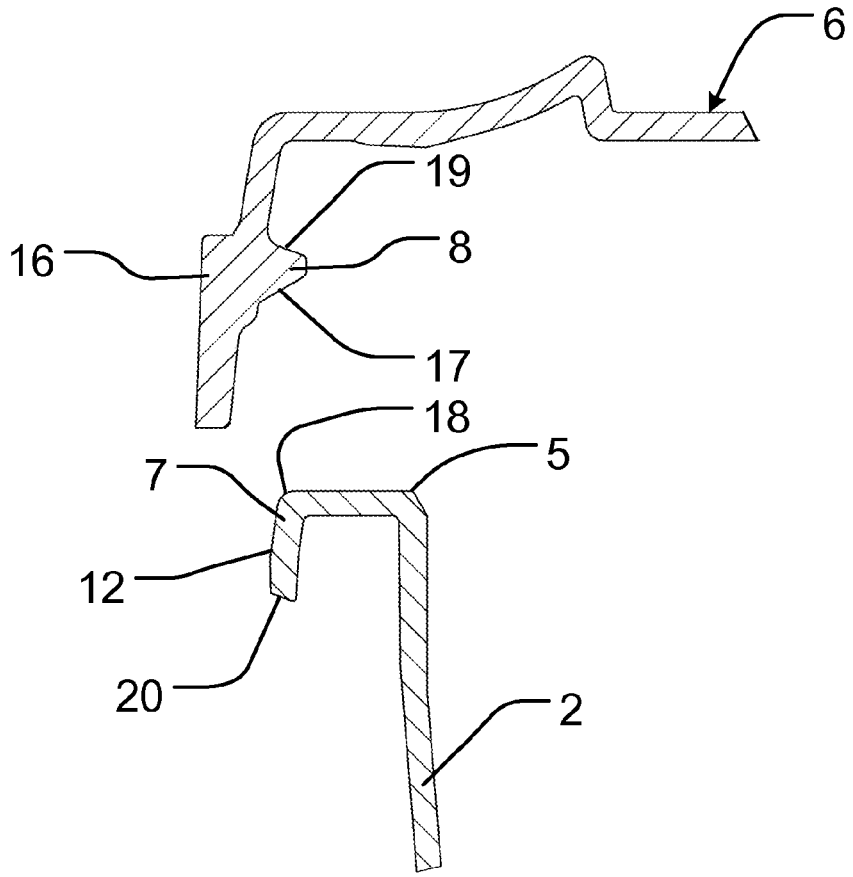
FIG. 5 is a cross-sectional detail on a larger scale of the container as indicated in FIG. 2, whereby the lid has been detached from the container.
Figure 6:
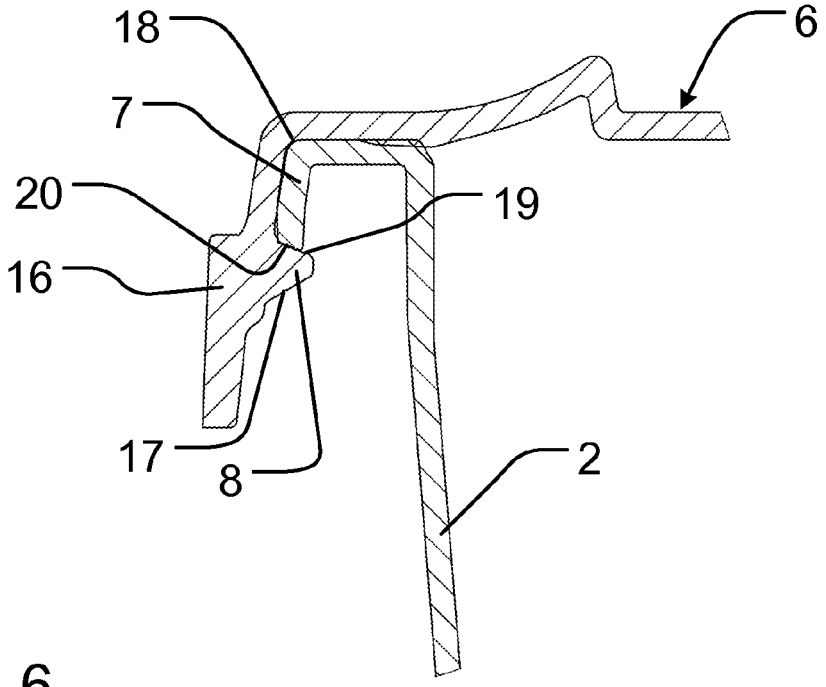
FIG. 6 is the cross-sectional detail of FIG. 5, whereby the lid has been attached on the container.

Alternatively to the above described mounting procedure for the lid, according to the invention, the lid 6 may also be brought into its locked position on the container 1 by means of an alternative mounting procedure. According to this alternative mounting procedure, in the second angular position of the lid 6 relative to the container 1, the lid may be pressed onto the peripheral rim of the top opening, whereby the radially outwards protruding flanges 7 of the peripheral rim 5 of the top opening 4 and the radially inwards protruding flanges 8 of the lid 6 snap over each other, thereby locking the lid onto the container. FIG. 5 shows a radial cross-section through a detail of the container 1 and the lid 6 before pressing the lid against the container, and FIG. 6 shows a corresponding cross-section of the container 1 and the lid 6 after the mounting of the lid on the container by snapping over of the radially outwards protruding flanges 7 of the peripheral rim 5 of the top opening 4 and the radially inwards protruding flanges 8 of the lid 6. FIGS. 7 and 8 each shows a sectional view taken along a line parallel to a central axis of the container and similarly illustrating the situation before and after the snapping over procedure.

In order to enable this alternative mounting procedure of the lid 6 on the container 1, the radially outwards protruding flanges 7 of the peripheral rim 5 of the top opening 4 and the radially inwards protruding flanges 8 of the lid 6, respectively, are adapted to, by pressing the lid 6 onto the peripheral rim 5 of the top opening 4, in the second angular position of the lid 6 relative to the container 1, snap over each other, thereby locking the lid onto the container. This adaptation of the radially outwards protruding flanges 7 of the peripheral rim 5 of the top opening 4 and the radially inwards protruding flanges 8 of the lid 6 may be achieved in any suitable way, for instance by means of the form of the flanges, their flexibility, their surface, their relative position, etc. In this application, the concept of adaptation of the flanges 7, 8 is also intended to include any suitable adaptation of elements related to and interacting with the flanges 7, 8, such as the rim 5 of the top opening 4 on which the radially outwards protruding flanges 7 of the container 1 are provided, and such as an outer downwards extending peripheral rim 16 of the lid 6 on which the radially inwards protruding flanges 8 are provided, etc.

Due to this alternative mounting procedure, it is possible to automatically mount the lid 6 on the container 1 by positioning the lid on the rim of the top opening in any angular position relative to the container, that is, the first angular position or the second angular position as defined above, subsequently pressing the lid onto the peripheral rim of the top opening, and finally providing the lid with a rotational force relative to the container. In this way, the assembly line equipment is not required to position the lids in any specific angular position in order to mount the lids on the containers. By finally providing the lid with a rotational force relative to the container, it may be ensured that, also in the case that the lid is firstly positioned in its first angular position, the lid is finally mounted on the container in its second angular position. Furthermore, in this way, it may be ensured that the lid is finally mounted in a well defined angular position in which end stops 11, 13 abut each other.

Figure 2:
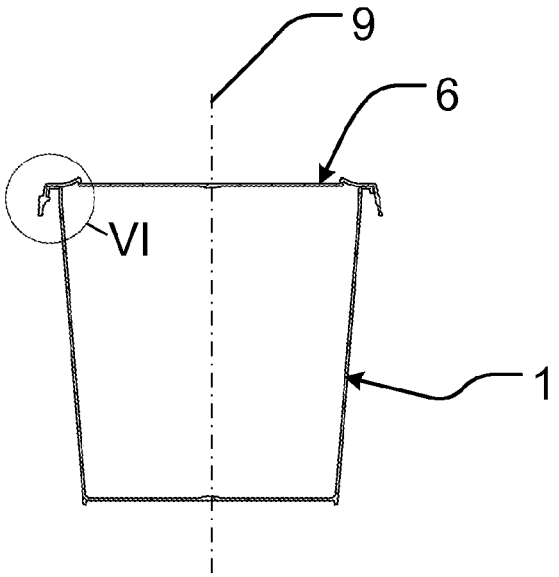
FIG. 2 is an axial section through the container shown in FIG. 1, hereby the lid has been attached on the container.
Figure 3:
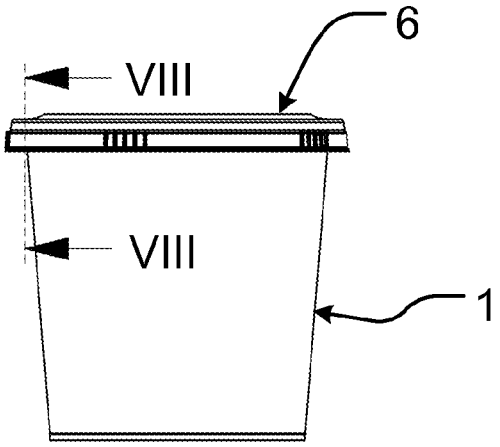
FIG. 3 is side view of the container shown in FIG. 1, whereby the lid has been attached on the container.
Figure 4:
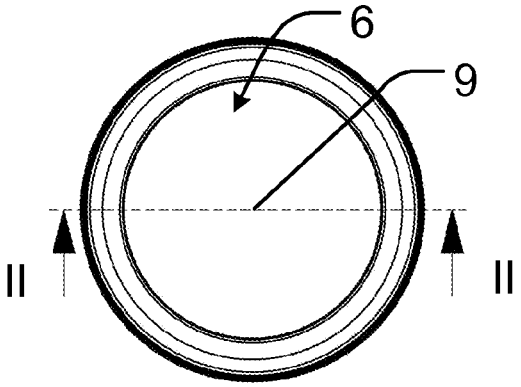
FIG. 4 is a top view of the container shown in FIG. 3.

Referring to FIGS. 5 and 6, it is seen that, in the embodiment shown, the radially outwards protruding flanges 7 of the peripheral rim 5 of the top opening 4 and the radially inwards protruding flanges 8 of the lid 6, respectively, form primary snap faces 17, 18 adapted to, in the second angular position of the lid 6 relative to the container 1, mutually contact each other before snapping over each other. The primary snap faces 17 of the lid form an acute angle with the central axis 9 of the peripheral rim 5 of the top opening 4, cf. FIGS. 1 and 2. Thereby, the snapping over of the flanges 7, 8 may be facilitated. Additionally or alternatively, the primary snap faces 18 of the peripheral rim 5 of the top opening 4 may form an acute angle with the central axis 9 of the peripheral rim of the top opening.

In the embodiments shown in the figures, the flanges 7 of the peripheral rim 5 of the top opening 4 protrude radially outwards, the flanges 8 of the lid 6 protrude radially inwards, and the primary snap faces 17 of the lid 6 extend in a downwards and radially outwards direction. In this embodiment, the primary snap faces 18 of the peripheral rim 5 may similarly extend in a downwards and radially outwards direction. However, according to the invention, it is also possible that the flanges 7 of the peripheral rim 5 of the top opening 4 protrude radially inwards, the flanges 8 of the lid 6 protrude radially outwards, and the primary snap faces 17 of the lid 6 and/or the primary snap faces 18 of the peripheral rim 5 extend in an upwards and radially outwards direction. In fact, the latter embodiment could, for instance, be realized by turning the container and lid shown in the figures upside down, whereby a container similar to a so-called CD cake box could be obtained.

The primary snap faces 17, 18 of at least one of the lid 6 and the peripheral rim 5 of the top opening 4 may form an angle with the central axis 9 of the peripheral rim of the top opening of less than 75 degrees, preferably less than 70 degrees and more preferred less than 65 degrees.

Referring to FIGS. 5 and 6, it is seen that, in the embodiment shown, the radially outwards protruding flanges 7 of the peripheral rim 5 of the top opening 4 and the radially inwards protruding flanges 8 of the lid 6, respectively, form secondary snap faces 19, 20 adapted to, in the second angular position of the lid $ relative to the container, mutually contact each other after snapping over of the flanges 7, 8. The secondary snap faces 19, 20 of both the lid 6 and the peripheral rim 5 of the top opening 4 form an acute angle with the central axis 9 of the peripheral rim 5 of the top opening 4. Thereby, the final part of the snapping over action of the flanges 7, 8 may be facilitated, and it may be ensured that the lid 6 is properly tightened to the peripheral rim 5 of the top opening 4. However, in other embodiments, it is possible that only the secondary snap faces 19 of the lid 6 or only the secondary snap faces 20 of the peripheral rim 5 of the top opening 4 form an acute angle with the central axis 9.

In the embodiments shown in the figures, the flanges 7 of the peripheral rim 5 of the top opening 4 protrude radially outwards, the flanges 8 of the lid 6 protrude radially inwards, and the secondary snap faces 19, 20 of the lid and the peripheral rim of the top opening extend in an upwards and radially outwards direction. However, according to the invention, it is also possible that the flanges 7 of the peripheral rim 5 of the top opening 4 protrude radially inwards, the flanges 8 of the lid 6 protrude radially outwards, and the secondary snap faces 19 of the lid and/or the secondary snap faces 20 of the peripheral rim 5 of the top opening 4 extend in a downwards and radially outwards direction.

In the embodiments shown in the figures, the radially inwards protruding flanges 8 of the lid 6 are provided on the outer downwards extending peripheral rim 16 of the lid, and the outer downwards extending peripheral rim 16 of the lid may be adapted to flex elastically in order to assist the radially inwards protruding flanges 8 of the lid in snapping over the radially outwards protruding flanges 7 of the peripheral rim 5 of the top opening 4.

Furthermore, in the embodiments shown in the figures, the peripheral rim 5 of the top 4 opening may be adapted to flex elastically in order to assist the flanges 7, 8 in snapping over each other.

In the embodiments shown in the figures, the radially inwards protruding flanges 8 of the lid 6 have a longitudinal extension that is smaller than the longitudinal extension of the radially outwards protruding flanges 7 of the peripheral rim of the top opening. However, this relative relationship may just as well be the other way around, or the flanges 7, 8 may be of substantially even longitudinal extension. Furthermore, as it is seen in FIG. 1, the radially outwards protruding flanges 7 of the peripheral rim 5, at a first end, have a tapering portion 21 reducing its radius to the outer radius of the rim 5 in the spaces 10 separating each pair of flanges 7. Each combination of a radially outwards protruding flange 7 and the outside of the rim 5 in a space 10 may also in continuation of each other form one element having a continuously tapering width making the difference between the flanges 7 and the outside of the rim 5 in the spaces 10 invisible; however, this difference, that is, where this element changes from being the flange 7 to being the outside of the rim 5 in the space 10, will depend on whether the radially inwards protruding flanges 8 of the lid 6 may pass substantially freely in between the radially outwards protruding flanges 7 or not; if they may pass substantially freely, they are located at the spaces 10.

FIGS. 13 to 16 shows another embodiment of the container 1 and lid 6 according to the invention, wherein the detachable lid 6 is provided with a downwards protruding peripheral rim 22 adapted to engage sealingly on the inside of the peripheral rim 5 of the top opening 4 of the container 1 when the lid is mounted on the container. Thereby, a fluid tight seal may be obtained as it is well illustrated in FIG. 15. The downwards protruding peripheral rim 22 may be slightly conical on its outside so that it tapers in downward direction; thereby obtaining a tight seal by tightening the lid 6 on the container 1 may be further facilitated.

In the context of this description, the expression inwards, when relating to the radially protruding flanges 8 of the lid 6 or the radially protruding flanges 7 of the peripheral rim 5 of the top opening 4 or when relating to anything else along the periphery of the container 1 means directed against a central vertical axis through the container when the container 1 is placed with its bottom 3 on a horizontal surface and when the lid 6 is engaged with the peripheral rim of the top opening. Outwards relates to the opposite direction, which is away from said central vertical axis. In fact, all directions mentioned in this application relate to the container 1 when it is placed with its bottom on a horizontal surface.

The invention claimed is:

1. A combination of a container and a detachable lid, said container comprising a side wall, a bottom and a peripheral rim at an open top of the side wall, said peripheral rim including a plurality of mutually spaced, radially outwardly-extending first flanges that provide circumferential spaces therebetween, said first flanges defining downwardly-extending skirt portions which taper in height from a first circumferential end to a second circumferential end, and said first flanges defining circumferential primary and secondary snap faces, said detachable lid comprising a plurality of circumferentially spaced, radially inwardly-extending second flanges that can fit in the circumferential spaces between the first flanges when the lid is positioned in a first angular orientation relative to the peripheral rim of the container, and when the lid is moved downwardly on said container when in said first angular orientation, and thereafter rotated relative to the peripheral rim to a second angular position, the second flanges will engage the first flanges and lock said lid onto said container, and wherein said second flanges include primary and secondary snap faces, such that when said lid is at said second angular position and pressed downwardly on said container, said primary snap faces of said second flanges will move down and snap over said primary snap faces of said first flanges, and thereafter said secondary snap faces of said second flanges will abut said secondary snap surfaces of said first flanges to lock said lid on said container.

2. The combination according to claim 1, wherein said first and second flanges include mutually interacting end stops to prevent angular rotation of said lid past said second angular position.

3. The combination according to claim 1, wherein said lid includes an inner rim for sealing contact with said peripheral rim when said lid is locked on said container.

4. The combination according to claim 1, wherein said peripheral rim defines a central axis, and wherein the primary snap faces of said first flanges extend upwardly toward said central axis at an acute angle relative thereto.

5. The combination according to claim 2, wherein said acute angle is less than 75°.

6. The combination according to claim 2, wherein said secondary snap faces of said first flanges extend downwardly toward said central axis at an acute angle relative thereto.

7. The combination according to claim 1, wherein said lid includes a downwardly-extending rim and said second flanges extend radially inwardly from said downwardly-extending rim, said primary and secondary snap faces of said second flanges being located on respective lower and upper surfaces thereof.

8. The combination according to claim 7, wherein said primary snap faces of said second flanges extend upwardly at an acute angle relative to a central axis of said peripheral rim when said lid is locked on said container.

9. The combination according to claim 8, wherein said secondary snap faces of said second flanges extend downwardly at an acute angle relative to said central axis when said lid is locked on said container.

10. The combination according to claim 7, wherein said downwardly-extending rim is elastically flexible to assist snapping of said second flanges over said first flanges when locking said lid on said container.

11. The combination according to claim 7, wherein each downwardly-extending skirt portion of said first flanges includes a rounded indentation, and each secondary snap face of said second flanges of said lid includes a said rounded protrusion for positioning in a corresponding rounded indentation when said lid is locked on said container at said second angular position of said lid.

* * * * *